United States Patent [19]

Boehlau et al.

[11] Patent Number: 4,650,032

[45] Date of Patent: Mar. 17, 1987

[54] NOISE BARRIER

[75] Inventors: Ernst Boehlau, 25 Bucks Green Road, Thornhill, Ontario; Hans D. F. Toepell, Islington, both of Canada

[73] Assignee: Ernst Boehlau, Thornhill, Canada

[21] Appl. No.: 698,394

[22] Filed: Feb. 5, 1985

[30] Foreign Application Priority Data

Feb. 7, 1984 [CA] Canada ..... 446956

[51] Int. Cl.[4] ..... G10K 11/00

[52] U.S. Cl. ..... 181/210; 181/284

[58] Field of Search ..... 181/210, 284, 287; 52/729, 732, 721, 726, 731

[56] References Cited

U.S. PATENT DOCUMENTS

| | | | |
|---|---|---|---|
| Re. 28,976 | 9/1976 | Zinn | 52/732 X |
| 2,232,793 | 2/1941 | Lowry | 52/732 X |
| 3,195,698 | 7/1965 | Codren | 52/729 X |
| 3,538,658 | 11/1970 | Lavalley et al. | 52/731 X |
| 3,592,289 | 7/1971 | Aysta et al. | 181/287 X |
| 4,042,061 | 8/1977 | Murakani | 181/210 |
| 4,306,631 | 12/1981 | Reusser | 181/210 |
| 4,325,457 | 4/1982 | Docherty et al. | 181/210 |
| 4,402,384 | 9/1983 | Smith et al. | 181/210 |

*Primary Examiner*—Benjamin R. Fuller

*Attorney, Agent, or Firm*—James D. Fornari

[57] ABSTRACT

A panel is provided for use in a sound absorbing wall structure. The panel includes a front of wood based material having perforations, a back parallel with the front and separated from the front. Sound absorbing material is positioned in engagement with the front within the space covering the perforations so that the panel absorbs sound directed at the perforated front of the panel by absorption in the material of the front as well as in the sound absorbing material.

16 Claims, 7 Drawing Figures

NOISE BARRIER

This invention relates to sound absorbant wall structures for use particularly along highways to contain traffic noise and limit the disturbance created by traffic adjacent the highway.

Increased traffic density in suburban surroundings has caused noise pollution along the sides of such highways. Attempts have been made to both contain this noise within the confines of the highway and to absorb the sound in structures parallel to the highway. Such attempts have centered primarily around the use of wall structures built along the sides of the highway and most commonly to structures which both reflect some noise back towards the highway and absorb some of the noise. These structures are referred to generally as "sound absorbant" walls. If such structures work efficiently, then the areas surrounding the highways will be protected from traffic generated noise to a very large extent.

It has been found that sound absorbant wall structures can be both expensive and not very attractive and these considerations often take precedence over the effectiveness of the wall. Therefore, among the requirements for such structures are that they be pleasing to the eye, inexpensive to assemble and maintain, and replacable in sections should they be damaged. They should of course also resist anticipated wind loads, be relatively simple to assemble using conventional tools, and manufacturable in different heights for different environments.

Existing sound absorbing wall structures fall into two main types. Firstly those using pre-fabricated concrete sections between posts, and secondly steel-faced panelling which is also positioned between posts. Concrete is heavy, not very attractive and gives a massive appearance which does not enhance the environment visually. Further, because of the weight, such walls require significant support with resultant narrow post spacings and heavy equipment to install. Steel panels also create problems because they require significant maintenance particularly around highways where salt is used in the winter time to break up ice on the highway. Further, they are not very pleasing to the eye, and because the steel requires working such as pressing, forming, welding, etc., they tend to be expensive to manufacture.

The purpose of the present invention is to overcome the difficulties inherent in prior art sound absorbing wall structures and to provide an inexpensive structure which is both pleasing to the eye and efficient in absorbing highway traffic sound.

Accordingly the invention provides panels made from wood sheets, spaced apart to contain sound absorbant material. The sheet facing traffic is perforated and in assembly the panels are attached to other panels to form sections between posts set in the ground.

The invention will be better understood with reference to the drawings in which.

Figure 1:
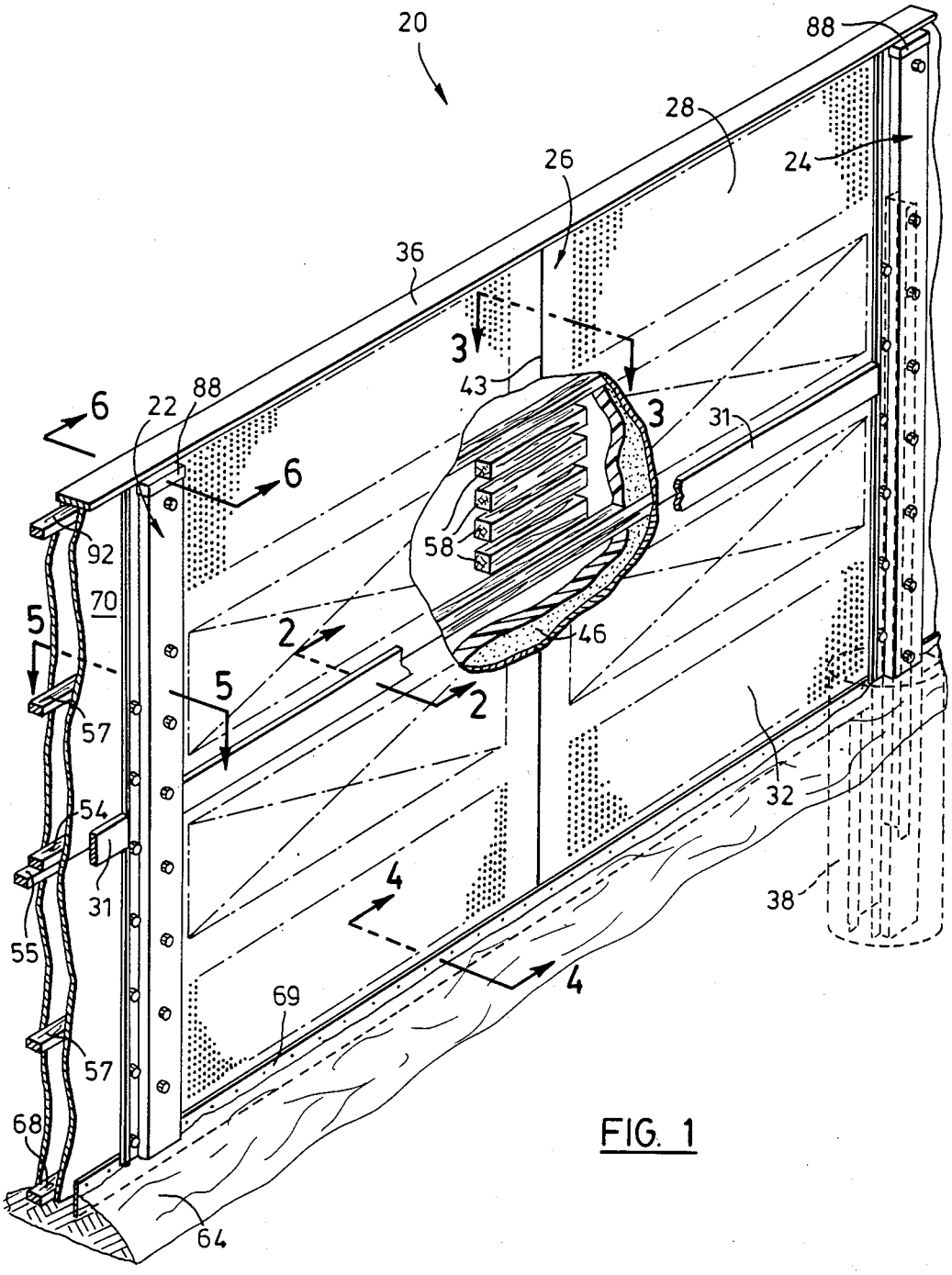
FIG. 1 is a diagrammatic perspective view of a portion of a preferred embodiment of a wall structure incorporating the invention.

Reference is made first to FIG. 1 which illustrates a wall structure 20 which is in effect a portion of a longer wall consisting of a series of posts 22, 24, etc. with the posts containing sections such as the section 26 between the posts 22, 24. As seen in this figure, the section 26 consists of upper and lower panels 28, 32. A cap 36 covers the top of the upper panel and crosses the posts 22, 24, and covers 31 (one of which is seen) are provided at both sides of the horizontal joints between the upper panel 28 and the lower panel 32.

Each of the posts is embedded in a concrete foundation such as foundation 38 supporting post 24.

The posts 22, 24 in the preferred embodiment are formed from steel strip and will be described with reference to FIG. 5. The panels, caps and covers are essentially of wood as will be described with reference to subsequent drawings.

Figure 2:
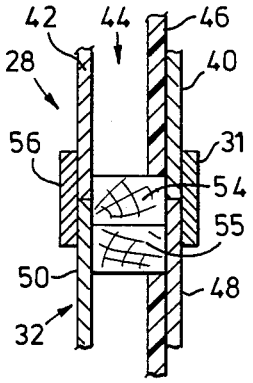
FIGS. 2–6 are sectional views of parts of the wall structure taken respectively on lines 2 to 6 of FIG. 1.

Reference is next made to FIGS. 1 and 2 to describe the structure of the preferred embodiment of panels as well as the connection between upper and lower panels 28, 32. The upper panel 28 consists of two perforated sheets of plywood forming a front 40 meeting at a vertical joint 43 and a back 42 of the same material meeting at a corresponding vertical joint (not seen in the drawings). The back is not perforated and an air gap 44 is formed between a back 42 and a sound absorbant layer 46 attached to the inner surface of the front 40.

The sound absorbant characteristics of panel 28 can be adjusted by preselecting ratios for thickness of sound absorbant layer 46 and air gap 44. Under certain conditions sound absorbant layer 46 may fill the entire space between front 40 and back 42 in which case the layer can be simply dropped between the front and the back without positive attachment.

The front 40 of panel 28 abuts a front 48 of panel 32 and the back 42 similarly abuts back 50 of panel 32. The sound absorbant layer 46 falls short of this abutment providing space for wood intermediate element 54 which is prefabricated with the upper panel 28. Another element 55 is built into the lower panel inwardly of the abutment sufficient to provide space for part of the element 54. The fronts and backs are nailed and glued to elements 54, 55.

The joints between the fronts and backs of panels 28, 32 are hidden by the cover 31 at the front and corresponding cover 56 at the back. Both covers are of wood nailed through the fronts and backs into the intermediate element 54 to rigidify the joint if necessary. The ends of the covers 31, 56 abut the posts 22, 24 to limit any tendency for vibration to move the panels longitudinally relative to the posts.

Figure 3:
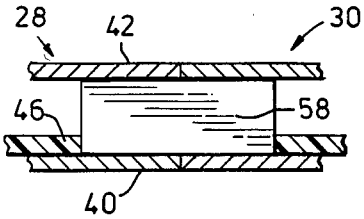

A different construction is used at the vertical joints between panels as shown in FIGS. 1 and 3 where the joint between adjacent sheets forming panels 28 is shown. Horizontal elements 58 are used at the joints 43 in the front 40 and back 42. Because of the inherent rigidity caused by the use of the cap 36 and covers 31 and 56, it is not normally necessary to cover the joints vertically other than to perhaps improve the appearance.

Figure 4:
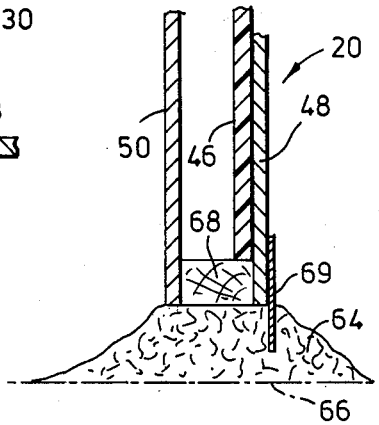

As seen in FIG. 4, below the bottom of panel 32, fill 64 is raised above the normal ground level 66 to effect adequate drainage. The fill would normally be of large aggregate gravel or other similar material which does not retain excess moisture. Front and back 48, 50 are attached to a bottom element 68 and a vertical strip 69 of galvanized steel is attached to the bottom of the lower panel 32 and projects into fill 64 in order to provide a positive seal in the event of ground settlement.

Figure 5:
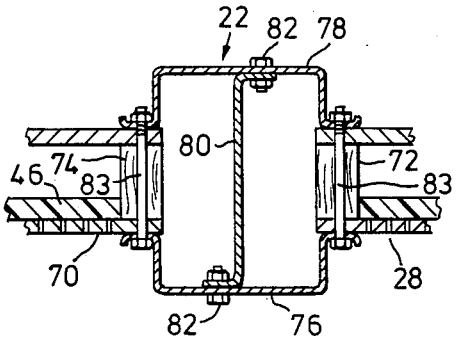

Reference is next made to FIG. 5 which is a sectional plan view of the post 22 near the top of the post. It will be seen that the post contains a vertical end of the panel 28 and a corresponding vertical end of an adjacent panel 70. The respective fronts and backs of these panels are attached to upright elements 72, 74 for stiffness and the post 22 contains the ends of the panels between a formed front portion 76 having a "top hat" cross section and a similar rear portion 78.

The panels are engaged in the posts between the corresponding pairs of flanges of the front and rear portions 76, 78 and retained by bolts 83 which pass through these flanges and through the panels. The panels are drilled in situ on site during assembly.

As seen in FIG. 5, the front and rear portions 76, 78 of the post 22 are retained in spaced relationship from one another by a Z-shaped web 80 attached by a plurality of bolts 82 to the respective front and rear portions. However, it is significant to note that the web 80 does not extend the full height of the post but is sufficient to enhance the stiffness of the post. This is seen in ghost outline in FIG. 1. Also by offsetting the bolts, the web is centered and the portions 76, 78 are identical.

The lower extremities of the portions forming post 24 are contained in the foundation 38 and the web extends only partly into the ground. Similarly the web does not extend to the top of the post. This preferred arrangement provides adequate rigidity and minimizes the use of materials. It will of course be evident that the top of the post must be rigid and this requirement is satisfied by the structure shown in FIG. 6. A long bolt 84 passes through the front and rear portions 76, 78 and through a tube 85 contained between these portions to space them apart. A nut 86 is used to tighten the front and rear portions 76, 78 onto the ends of the tube.

Figure 6:
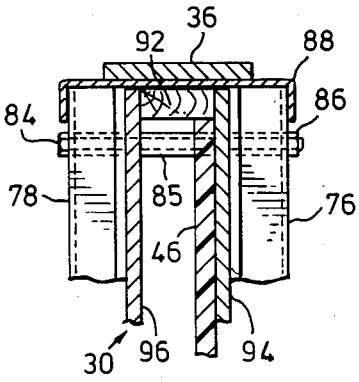

As also seen in FIG. 6, metal cap 88 is provided over the respective upper ends of the front and rear portions 76, 78 of the post. The wood cap 36 runs over the post and is nailed into a top element 92 which extends horizontally between the front and back 40, 42 of upper panel 28.

Reference is again made to FIG. 1 to describe the assembly of a typical wall incorporating a wall structure according to the invention. Firstly, the posts such as the exemplary posts 22, 24 are set in foundations such as foundation 38 in a vertical orientation to define the line of the wall.

Next, sections such as section 26 are assembled between pairs of posts. The upper and lower panels, 28, 32 are prefabricated so that the lower panel essentially ends at the element 55 at its uppermost extremity as previously described. This element can be in a series of sections with spaces between so that lifting ropes can be engaged between pairs of the element or alternatively, the element can be perforated to permit access for crane hooks. In any event, the element is lifted and one end engaged in post 22 by angling the panel into position with it against the other post 24. It will be noted from FIG. 5 that sufficient space is provided to allow the panel to move into contact with the web 80 so that the end adjacent post 24 can be aligned with the upright and the panel moved towards post 24 for engagement in this post. Once it is in the right position, the panel 32 can be located positively by engaging at least one of the bolts 83 in each of the posts to maintain the panel at the right height relative to the ground. Next, the upper panel is positioned in the same way but with clearance above the lower panel 32. As soon as the upper panel 28 is located in the posts, it is then lowered so that the element 54 engages inside the front and back of the lower panel 32 as shown in FIG. 1. At this stage, the assembly can be completed by engaging all of the bolts 83, adding the post caps 88, and the cover 36. The preferred embodiment also includes the horizontal covers 31, 56 over the joint between the upper and lower panels but this is not an essential part of the structure. It has been found however that such covers enhance the appearance and this is why they are included.

Fill 64 is then built up at the bottom of the structure and the wall is completed by repeating the above procedure for a series of sections between posts.

Each of the fronts and backs of the panels is preferably of pressure-treated Douglas Fir plywood having a thickness of 0.5 inches. The plywood as well as the other wood used in the structure is pressure-treated with preservative and waterproofing material to minimize deterioration and bacterial attack. The pressure treatment should be done according to Canadian Standards Association specification 080.9-M "Preservative Treatment of Plywood by Pressure Processes."

The sheet metal used in the posts should be hot-dip galvanized and all of the nails used are hot-dip galvanized or otherwise coated to minimize corrosion.

It will be noted from FIG. 5 that the panels are positioned in the posts such that they are not in engagement with the web 80. This is done deliberately to allow for some movement within the posts due to expansion caused by moisture changes etc. In fact, with suitable tolerancing, the bolts 83 used to clamp panels between front and rear portions 76, 78 of the posts could be left slightly loose until the assembly is in position and then tightened to cause compression forces on the ends of the panels between the portions 76 and 78.

Figure 7:
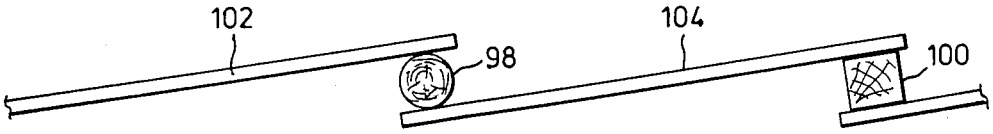
FIG. 7 is a composite diagrammatic plan view of alternative arrangements of the structures.

Reference is next made to FIG. 7 which is a composite diagrammatic plan view showing two different embodiments. Normally the posts in any structure would be similar but in this composite two different posts are shown. Firstly, a round post 98 is shown along with a square post 100. The posts may be of wood or concrete. The drawing also demonstrates how the wall structure could be created using sections 102, 104 which are nailed or bolted to opposite sides of the posts to provide a staggered effect which is both strong and with proper proportioning, can provide a pleasing appearance. It also has the advantage that the sections are angled with reference to the general line of the wall and this can be used to reflect noise selectively to some extent.

Depending on soil conditions, posts 98 and 100 could be rammed into augered holes in the ground thus eliminating concrete foundation 38 (FIG. 1) to reduce cost.

It will be evident that the invention can take many forms within the scope of the inventive concept as defined in the claims. For instance the fronts and backs could be of wood-based materials other than plywood although the sound deadening afforded by the plywood may be affected since other materials would have different characteristics. However, it will be appreciated that for the purposes of this invention the term "wood-based material" is to include plywoods, chip based materials, and materials made up generally by gluing smaller pieces of wood to create the size of the finished fronts and backs.

The embodiments of the invention in which an exclusive property or privilege is claimed are defined as follows:

1. A panel for use in a sound absorbing wall structure, the panel comprising:

a front of wood based material, the front having perforations;

an unperforated back;

separating means between the front and the back to define a space between the front and the back and to maintain the front and back in generally parallel relationship to one another;

sound absorbing material in engagement with the front within said space and covering the perforations and spaced from the back whereby the panel absorbs sound directed at the perforated front of the panel by absorption in the material of the front as well as in the sound absorbing material and an air gap is formed between the back and sound absorbing material.

2. A panel as claimed in claim 1 in which the front is of plywood.

3. A panel as claimed in claim 1 in which the separating means comprises wood strips.

4. A panel as claimed in claim 1 in which the front and rear are of plywood and the separating means is of wood strips.

5. A panel as claimed in claim 4 in which the sound absorbing material fills only a portion of the space leaving a gap between the sound absorbing material and the back.

6. The sound absorbing panel of claim 1, wherein a multiplicity of panels thereof is connected to form a sound absorbing wall structure wherein adjacent panels sections are connected together by a plurality of upright posts between panel sections and wherein said panel sections comprise at least one panel.

7. The sound absorbing panel of claim 1, wherein a multiplicity of panels thereof is connected to form a sound absorbing wall structure, wherein adjacent panel sections are connected together by a plurality of upright posts between panel sections wherein said panel sections comprise at least one panel wherein each post comprises distinct and separate front and rear post portions being symmetrical and complimentary, said portions integrally connected, when in use, by a separate web structure of alternate posturing for connection thereto, the sound absorbing wall sections being secured between said front and rear post portions integrally with said web means.

8. The structure of claim 6 wherein the posts are constructed of wood with adjacent sound absorbing sections attached to corresponding posts at their ends, with the posts located laterally between those sections' ends.

9. The structure of claim 6, wherein each post comprises a front portion, a rear portion and a web between these portions, each of the portions and web being separate distinct portions for being secured in the ground and for connection to one another; and each of the front and rear portions securing the panels of the sound absorbing wall therebetween.

10. The structure of claim 9, wherein each web comprises a length of material carrying flanges directed outwardly at generally 90° from the web at each end, to which flanges the front and rear portions are connected.

11. The posts of claim 10, wherein each flange extends in an opposite direction.

12. The posts of claim 9, wherein each of the front and rear portions have a top hat cross-section.

13. The posts of claim 10, wherein each of the front and rear portions have a top hat cross-section.

14. The posts of claim 11, wherein each of the front and rear portions have a top hat cross-section.

15. The posts of claim 11, wherein the webs are shorter than the front and rear portions.

16. The posts of claim 14, wherein the webs are shorter than the front and rear portions.

* * * * *